US006767260B2

(12) United States Patent
Beloritsky et al.

(10) Patent No.: US 6,767,260 B2
(45) Date of Patent: Jul. 27, 2004

(54) HYPERBOLOID ELECTRICAL CONTACT

(75) Inventors: Victor Beloritsky, Windham, NH (US); Thomas D. Coe, Boxford, MA (US); Robert P. Lascelles, York, ME (US); W. William Podszus, Newfields, NH (US)

(73) Assignee: QA Technology Company, Inc., Hampton, NH (US)

( * ) Notice: Subject to any disclaimer, the term of this patent is extended or adjusted under 35 U.S.C. 154(b) by 11 days.

(21) Appl. No.: 10/364,737

(22) Filed: Feb. 11, 2003

(65) Prior Publication Data

US 2003/0162447 A1 Aug. 28, 2003

Related U.S. Application Data

(63) Continuation-in-part of application No. 10/084,877, filed on Feb. 28, 2002, now abandoned.

(51) Int. Cl.[7] ..... H01R 13/187
(52) U.S. Cl. ..... 439/843; 439/891
(58) Field of Search ..... 439/843–847, 439/851–854, 891

(56) References Cited

U.S. PATENT DOCUMENTS

| | | | | |
|---|---|---|---|---|
| 1,833,145 | A | 11/1931 | Wilhelm | |
| 2,434,358 | A | 1/1948 | Frank | 174/84 |
| 2,681,441 | A | 6/1954 | Linn | 339/259 |
| 2,900,631 | A | 8/1959 | Love | 340/367 |
| 3,023,789 | A | 3/1962 | Bonhomme | 140/93 |
| 3,042,895 | A | 7/1962 | Bonhomme | 339/176 |
| 3,229,356 | A | 1/1966 | Bonhomme | 29/155.55 |
| 3,470,527 | A | 9/1969 | Bonhomme | 339/256 |
| 3,557,428 | A | 1/1971 | Bonhomme | 29/203 |
| 3,641,483 | A | 2/1972 | Bonhomme | 339/217 S |
| 3,858,962 | A | 1/1975 | Bonhomme | 339/256 |

(List continued on next page.)

FOREIGN PATENT DOCUMENTS

| | | |
|---|---|---|
| DE | 1 082 957 | 6/1960 |

(List continued on next page.)

*Primary Examiner*—Ross Gushi
(74) *Attorney, Agent, or Firm*—Weingarten, Schurgin, Gagnebin & Lebovici LLP

(57) ABSTRACT

A hyperboloid contact socket is provided which can be manufactured in a cost efficient manner using automated high speed manufacturing processes and wherein different types of terminations can be affixed to the contact socket as desirable for user requirements.

The contact socket comprises a tubular body of metal or other suitable conductive material and preferably having at one end a lip defining an entrance aperture for receiving a mating pin terminal and having on the opposite end a termination of an intended configuration for attachment to a circuit board or other device or item. The tubular body contains a plurality of conductive wires conductively and permanently affixed at their respective ends to respective inner surfaces at or near the outer and inner ends of the body and disposed in an angular disposition to the longitudinal axis to form the shape of a single sheet hyperboloid. No additional sleeves or tubes are necessary to secure the contact wires as in conventional hyperboloid contacts.

In one aspect of the invention a mandrel employed to orient the wires within the tubular body during fabrication of the contact socket remains attached to the tubular body after assembly of the contact wires and serves as a connecting pin to which various terminations can be attached. This aspect of the invention provides conductive and permanent attachment of the wires to the tubular body and to the mandrel through deformation of the body by rolling, crimping, swaging or other suitable means.

28 Claims, 10 Drawing Sheets

U.S. PATENT DOCUMENTS

| | | | | | |
|---|---|---|---|---|---|
| 4,203,647 | A | | 5/1980 | Bonhomme | 339/256 R |
| 4,447,108 | A | | 5/1984 | Ghigliotti et al. | 339/256 RT |
| 4,486,068 | A | | 12/1984 | Ghigliotti et al. | 339/252 P |
| 4,572,606 | A | | 2/1986 | Neumann et al. | 339/262 R |
| 4,614,029 | A | | 9/1986 | Neumann et al. | 29/882 |
| 4,621,422 | A | | 11/1986 | Neumann et al. | 29/882 |
| 4,657,335 | A | | 4/1987 | Koch et al. | 339/256 R |
| 4,662,706 | A | | 5/1987 | Foley | 339/256 R |
| 4,693,002 | A | | 9/1987 | Neumann et al. | 29/882 |
| 4,734,063 | A | | 3/1988 | Koch et al. | 439/844 |
| 4,752,253 | A | | 6/1988 | Neumann et al. | 439/852 |
| 4,753,616 | A | | 6/1988 | Molitor | 439/787 |
| 4,812,129 | A | * | 3/1989 | Rofer et al. | 439/79 |
| 4,840,587 | A | | 6/1989 | Lancella | 439/852 |
| 4,840,588 | A | | 6/1989 | Lancella | 439/851 |
| 5,033,982 | A | | 7/1991 | Lucas | 439/750 |
| 5,036,583 | A | | 8/1991 | Prochaska et al. | 29/882 |
| 5,106,328 | A | | 4/1992 | Prochaska et al. | 439/751 |
| 5,108,316 | A | | 4/1992 | Yamada et al. | 439/660 |
| 5,152,696 | A | | 10/1992 | Krajewski et al. | 439/75 |
| 5,203,813 | A | | 4/1993 | Fitzsimmons et al. | 29/876 |
| 5,326,289 | A | | 7/1994 | Leisey | 439/851 |
| 5,498,838 | A | * | 3/1996 | Furman | 174/74 R |
| 5,601,457 | A | | 2/1997 | Le Gall | 439/843 |
| 5,667,413 | A | | 9/1997 | Trafton | 439/843 |
| 5,690,518 | A | | 11/1997 | Roy et al. | 439/851 |
| 6,004,172 | A | * | 12/1999 | Kerek | 439/891 |
| 6,062,919 | A | | 5/2000 | Trafton | 439/843 |
| 6,102,746 | A | | 8/2000 | Nania et al. | 439/675 |
| 6,328,615 | B1 | | 12/2001 | Safai | 439/851 |
| 2002/0016108 | A1 | | 2/2002 | Creze | 439/843 |
| 2002/0022411 | A1 | | 2/2002 | LaCoy | 439/843 |
| 2002/0037674 | A1 | | 3/2002 | LaCoy | 439/851 |
| 2003/0068931 | A1 | | 4/2003 | Swearingen et al. | 439/843 |
| 2003/0077950 | A1 | | 4/2003 | Swearingen et al. | 439/843 |

FOREIGN PATENT DOCUMENTS

| | | |
|---|---|---|
| DE | 1 415 491 | 10/1968 |
| DE | 1 934 580 | 2/1971 |
| DE | 297 05 603 | 6/1997 |
| EP | 0 968 548 | 12/2000 |
| EP | 1 158 620 | 11/2001 |
| FR | 2 709 024 | 2/1995 |
| GB | 993.316 | 5/1965 |
| RU | 1274038 | 11/1986 |

* cited by examiner

HYPERBOLOID ELECTRICAL CONTACT

CROSS REFERENCE TO RELATED APPLICATIONS

This application is a continuation-in-part of U.S. application Ser. No. 10/084,877 entitled HYPERBOLOID ELECTRICAL CONTACT filed on Feb. 28, 2002 now abandoned the disclosure of which is incorporated by reference herein.

STATEMENT REGARDING FEDERALLY SPONSORED RESEARCH OR DEVELOPMENT

N/A

BACKGROUND OF THE INVENTION

Hyperboloid electrical contacts or contact sockets are known for their reliability, resistance to vibration, low insertion force, low electrical resistance and high number of insertion/extraction cycles. A conventional hyperboloid contact socket includes an inner tubular sleeve which is open at both ends and which is located coaxially within two cylindrical sections that form an outer shell. The distal end of one of the outer sections is machined to form a cavity for permanently affixing wires to the contact either by soldering or crimping. Alternatively the distal end can be machined to form a pin to be soldered or press fit into a circuit board, or used to affix wires by wrapping them onto the pin. The proximal end of the second outer cylindrical section remains open to receive the male pin of a mating connector or device. A plurality of loose, or floating wires is arrayed within the inner sleeve to form the shape of a single sheet hyperboloid. At each end of the inner sleeve the wires are bent 180° outward so as to return axially between the inner and outer sleeves. The wire ends are thereby retained at each end of the inner sleeve by means of a press fit between the wires and the inner and outer sleeves as shown in the prior art FIG. 1. Some form of rolling, crimping, swaging or other suitable means to provide mechanical and conductive attachment is used to affix the outer sleeves at or near the axial midpoint of the inner sleeve. This contact configuration has been in use for many years and is known to present a difficult assembly task and to require expensive, high precision machined components. Additionally, due to the nature of the press fit retention of the wires, it is not uncommon for the wires to become separated from within the inner and outer sleeves, particularly during usage of the contact, thereby leading to field failures of the device in which it is in use. Additionally, this type of field failure can lead to damage of the mating male connector elements, further exacerbating the extent and cost of repair of the overall system in which the contact has been deployed. In addition, because of the concentric arrangement of the inner and outer cylindrical sections and the retained contact wires, the contact structure is larger in diameter than other forms of contacts and cannot therefore be used in applications requiring higher contact density, or in applications requiring the characteristics set forth above where miniaturization must be realized. Examples of prior art constructions are shown in U.S. Pat. Nos. 3,107,966, 3,229,356, 3,470,527 and 6,102,746.

It would be useful to provide a hyperboloid contact socket having a smaller outside diameter to permit use in applications requiring closer center distance spacing. It would also be useful to reduce the cost of manufacturing through the elimination of unnecessary parts and through improvement in the efficiency of assembly by permanent and conductive attachment of the contact wires into position within a contact body to form the hyperboloid contact area. It would also be useful to provide a contact socket which can be separately fabricated apart from a specific termination type, which subsequently can be readily affixed to different termination types. It would also be useful to provide a contact socket where the need for costly machined components is reduced or eliminated.

BRIEF SUMMARY OF THE INVENTION

In accordance with the present invention, a hyperboloid contact socket is provided which can be manufactured in a cost efficient manner using automated high speed manufacturing processes and wherein different types of terminations can be affixed to the contact socket as desirable for user requirements. The contact socket comprises a tubular body of metal or other suitable conductive material and preferably having at one end a lip defining an entrance aperture for receiving a mating pin terminal and having on the opposite end a termination of an intended configuration for attachment to a circuit board or other device or item. The tubular body contains a plurality of conductive wires welded or otherwise conductively and permanently affixed at their respective ends to respective inner surfaces at or near the outer and inner ends of the body and disposed in an angular disposition to form the shape of a single sheet hyperboloid. The body is preferably manufactured by deep drawing which is less expensive than precision machined parts usually required by conventional designs. The wires are preferably laser welded within the tubular body and are permanently attached directly to the inside of the tubular body. No additional sleeves or tubes are necessary to secure the contact wires as in conventional hyperboloid contacts. The novel contact socket can therefore have a diameter substantially less than that of conventional hyperboloid contacts for a given current rating, and the reduced diameter permits the novel contact sockets to be more densely packed for use in a connector, circuit board, device or other installation.

The process of fabricating the contact sockets can be implemented by high speed automatic equipment and assures consistent attachment of the contact wires within the tubular body. It is a benefit of the novel contact socket that the body containing the welded or otherwise conductively and permanently affixed wires, a subassembly denoted as the wire contact assembly, can be fabricated separately from the termination end. As a consequence, the same wire contact assembly can subsequently be attached to various termination types to suit utilization requirements. Typical termination types can be crimp, solder cup, pin or surface mount. As allowed by its configuration, the termination end is preferably manufactured by deep drawing which, again is less expensive than precision machined parts usually required by conventional designs.

In one aspect of the invention a mandrel employed to orient the wires within the tubular body during fabrication of the contact socket remains attached to the tubular body after assembly of the contact wires and serves as a connecting pin to which various terminations can be attached. This aspect of the invention provides conductive and permanent attachment of the wires to the tubular body and to the mandrel through deformation of the body, preferably by rolling, crimping, swaging or other suitable means.

BRIEF DESCRIPTION OF THE SEVERAL VIEWS OF THE DRAWING

The invention will be more fully described in the following detailed description in conjunction with the drawing in which.

DETAILED DESCRIPTION OF THE INVENTION

Figure 1:
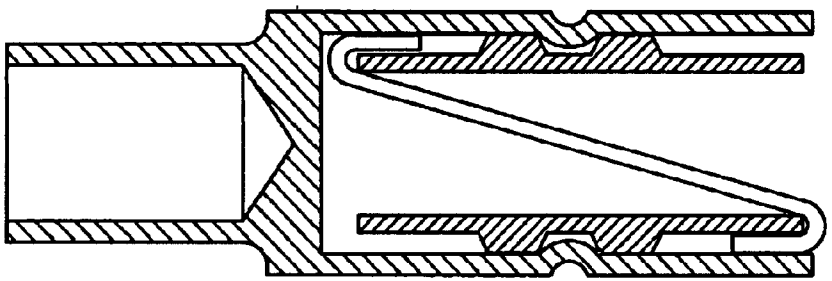
FIG. 1 PRIOR ART
FIG. 1 is a cutaway view of a prior art hyperboloid contact socket.
Figure 2:
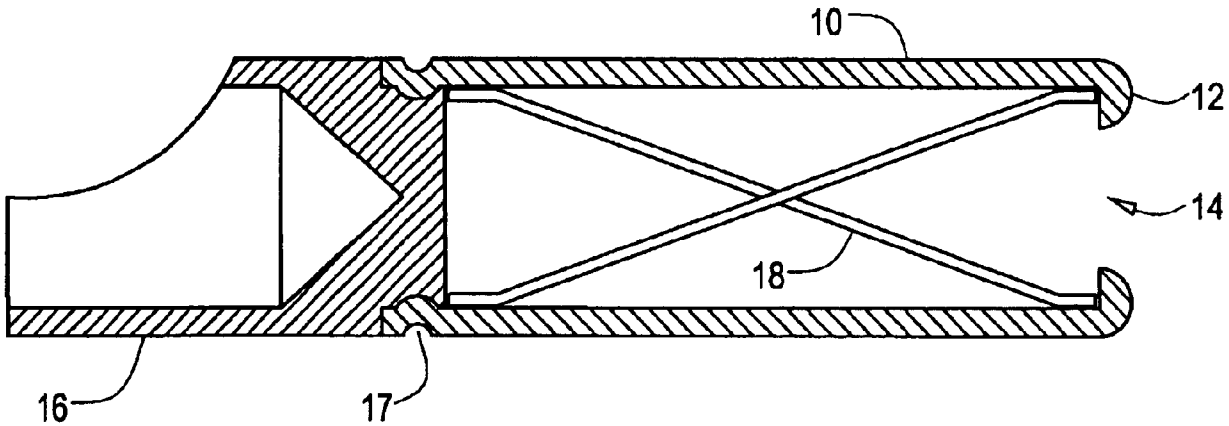
FIG. 2 is a cutaway view of an embodiment of a contact socket in accordance with the invention.
Figure 3:
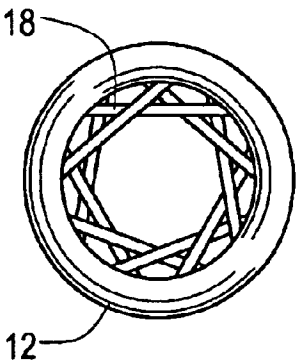
FIG. 3 is an end view of the contact socket of FIG. 2.

Referring to FIGS. 2 and 3 there is shown a contact socket in accordance with the invention which comprises a tubular body 10 of a suitable metal or other conductive material and having a lip 12 defining an aperture 14 for receiving a mating pin terminal, and having a termination 16 for attachment to a circuit board or other item. The tubular body contains a plurality of conductive wires 18 welded or otherwise conductively and permanently affixed at their respective ends to the outer and inner ends of the body and disposed in an angular disposition to the longitudinal axis to form a hyperboloid shape. In the illustrated embodiment, the body 10 is attached to termination 16 at juncture 17 by rolling, crimping, swaging or other suitable means to provide mechanical and conductive attachment.

Figure 4:
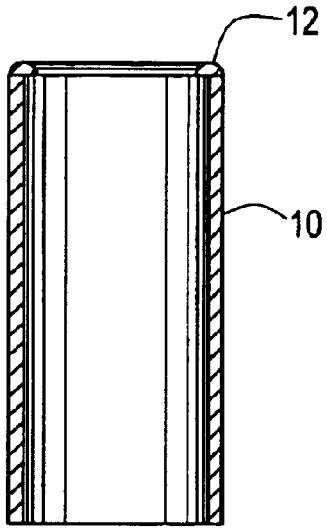
FIG. 4 is a cutaway side view of an embodiment of a tubular body used in the embodiment of FIG. 2.
Figure 5:
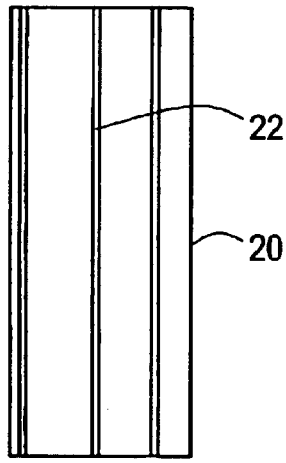
FIG. 5 is a side view of a mandrel usable in fabricating the novel contact socket of FIG. 2.
Figure 6:
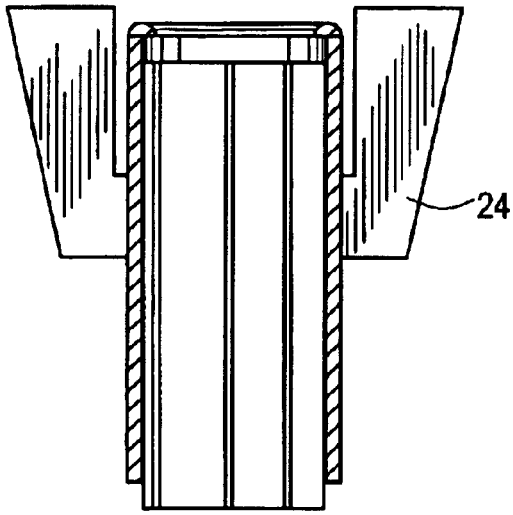
FIG. 6 is a cutaway side view of the mandrel inserted within the tubular body.
Figure 7:
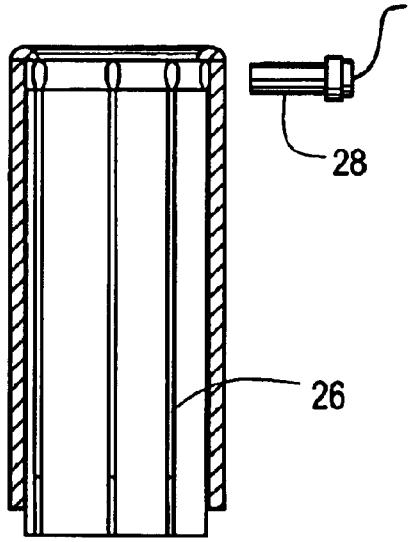
FIG. 7 is a cutaway side view illustrating the positioning of conductive wires at one end of the tubular body.

The method of making the contact socket will be described in conjunction with FIGS. 4–9. FIG. 4 shows a tubular body 10 preferably having a lip 12. In FIG. 5 there is shown a mandrel 20 with longitudinal wire receiving grooves 22 equispaced about the circumference of the mandrel. The body 10 is held by gripper jaws 24 and is positioned over the mandrel 20 as shown in FIG. 6. Wires 18 are inserted in respective grooves 22 to a position at which the outer ends of the wires abut the inner annular surface of lip 12. Referring to FIG. 7, the upper ends of the wires are conductively and permanently affixed, preferably by laser welding or other suitable means, to the confronting inner wall portion of the tubular body adjacent the lip 12 to secure the wire ends to the body at the outer end position. The laser welds are provided by energy from one or more welding heads 28 disposed in relation to the outer end of the body to provide welds at the intended positions.

It will be appreciated that the mandrel and tubular body can be movable relative to each other in different ways. The mandrel may be fixed and the body movable with respect thereto. Alternatively the tubular body may be fixed and the mandrel movable therein. Or the mandrel and body may be both movable in relation to each other. These various forms of relative movement are determined by the particular assembly machines employed.

Figure 9:
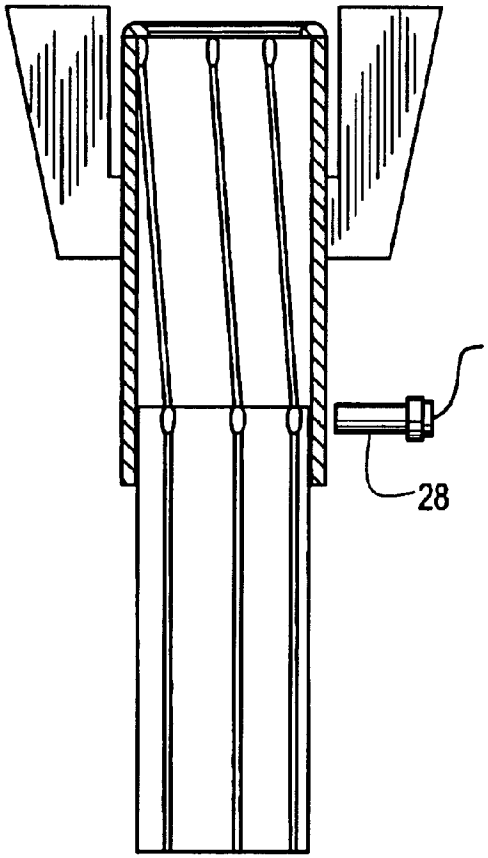
FIG. 9 is a cutaway side view illustrating the angular orientation of the conductive wires.
Figure 8:
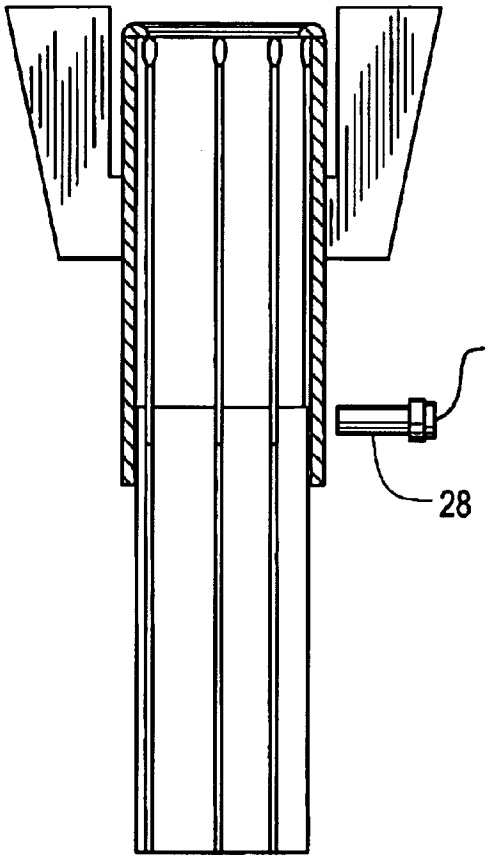
FIG. 8 is a cutaway side view illustrating the positioning of conductive wires at the other end of the tubular body.

After conductively and permanently affixing the upper ends of wires 18, the body and mandrel are moved relative to each other to position the lower end of the wires at the inner end of the tubular body, as shown in FIG. 8. The body and mandrel are rotated relative to each other by a predetermined angular extent to produce an angular orientation of the wires 18 as shown in FIG. 9. The lower end of the wires are conductively and permanently affixed, preferably by laser welding, or other suitable means to the confronting wall portion of the tubular body and the body and the mandrel are thereafter separated. The resultant body having the angularly disposed wires form a hyperboloid shape which accommodates and provides electrical engagement with a terminal pin inserted into the contact socket.

Figure 10:
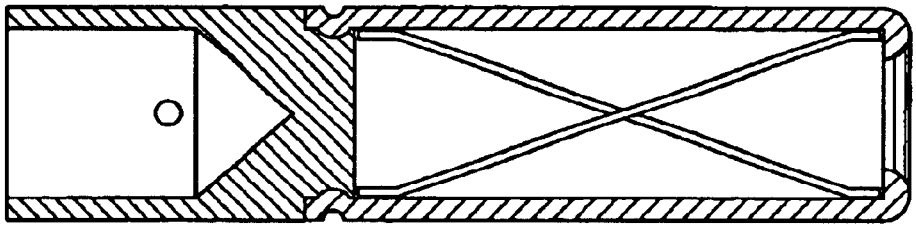
FIG. 10 is a cutaway side view illustrating a crimp termination.
Figure 11:
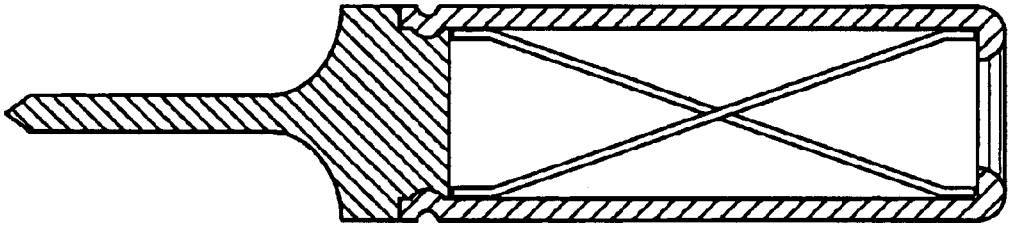
FIG. 11 is a cutaway side view illustrating a pin termination.
Figure 12:
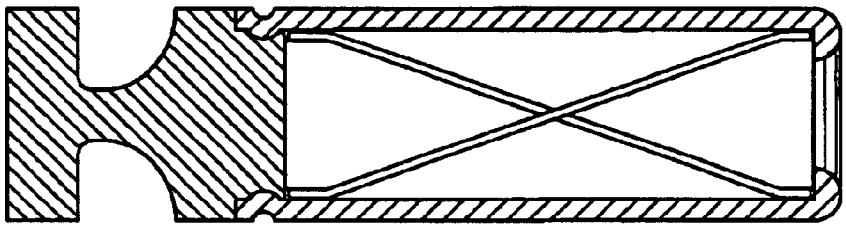
FIG. 12 is a cutaway side view illustrating a surface mount pad termination.

The body 10 with the hyperboloid contact wires welded or otherwise conductively and permanently affixed therein is mechanically and electrically attached to the termination 16 by any suitable technique such as rolling, crimping, swaging, or other suitable means to provide mechanical and conductive attachment. The termination can be of various types to suit particular requirements. For example, the termination may be of the solder cup type as shown in FIG. 2, a crimp type as show in FIG. 10, a pin terminal as shown in FIG. 11, or a surface mount pad as shown in FIG. 12. The termination may be integrally formed with the body in an alternative construction.

Figure 14:
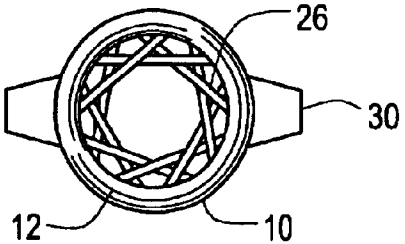
FIG. 14 is an end view of the embodiment of FIG. 13.
Figure 13:
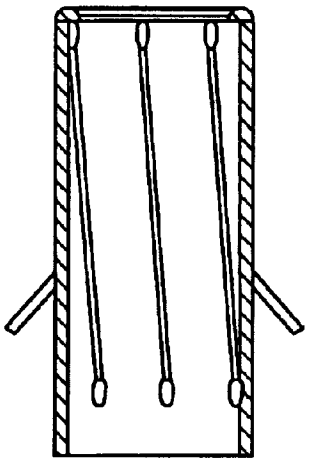
FIG. 13 is a cutaway side view illustrating mounting tabs.

The contact socket usually has one or more retention elements for securing the contact socket in a housing or receptacle. In the embodiment illustrated in FIGS. 13 and 14 the retention elements are in the form of wings or outwardly angled tabs 30 which can orient and lock the contact socket into an associated housing. The tabs can be integral with the body 10 or can be separate elements affixed to the body. The retention elements can be of other forms such as barbs or ribs, which per se are known.

Figure 15:
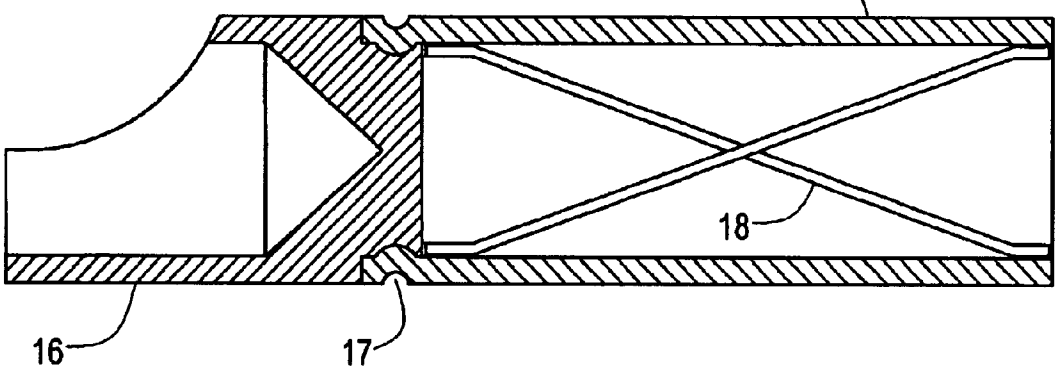
FIG. 15 illustrates an alternative embodiment of the contact socket in accordance with the invention.

In the embodiment described above, the tubular body 10 has a lip 12 which defines an aperture for receiving and guiding a mating pin during insertion into the contact socket. The lip is also beneficial to protect the confronting ends of the wires 18 from damage during insertion of the mating pin into the contact socket. In an alternative embodiment, the lip can be omitted, as shown in FIG. 15.

The novel contact socket can be fabricated of various materials which are themselves known in the electrical arts. For example, the tubular body can be gold plated copper alloy, and the conductive wires can also be gold plated copper alloy. Plated or unplated material may be employed depending on particular user requirements and specifications.

The contact socket according to the invention provides substantial benefits over the known art. The contact wires are conductively and permanently attached directly to the inside of the tubular contact body, and no additional sleeves or tubes are necessary to secure the contact wires, as in conventional hyperboloid contacts. The novel contact socket can therefore have a diameter substantially less than that of conventional hyperboloid contacts for a given current rating. The reduction in diameter reduces the center distance necessary for locating contact sockets within the insulating material of a connector, circuit board or other item, which is highly desirable in miniaturizing electronic assemblies.

The body of the contact socket can be manufactured by deep drawing, which is less expensive than precision machined parts required by conventional designs. The novel contact socket also uses less wire in its fabrication, as the two 180° reverse bends that are integral to the construction of a conventional hyperboloid contact have been eliminated. For this reason, and also due to the elimination of additional sleeves or tubes, the novel contact socket can be fabricated at a lower cost than a conventional hyperboloid socket.

The assembly technique using laser welding, which does not rely on the affixation of loose, or floating wires during its final assembly as in a conventional hyperboloid socket, is suitable for high volume automated manufacturing processes which assure consistent attachment of the contact wires and a reliable rugged product. These factors contribute to a higher yield at time of manufacture, which also contributes to a lower cost of manufacturing.

It is especially beneficial that the novel contact socket can have a termination separately fabricated and attached to the body containing the welded or otherwise conductively and permanently affixed wires, namely the wire contact assembly. Thus the same wire contact assembly can be attached to various termination types, which simplifies inventory and manufacturing requirements and which reduces costs.

Figure 16:
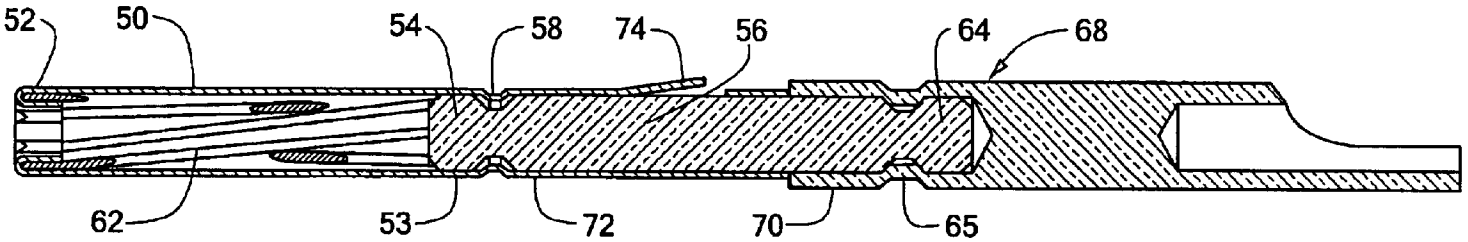
FIG. 16 is a cutaway view of a preferred embodiment of a contact socket in accordance with the invention.
Figure 17:
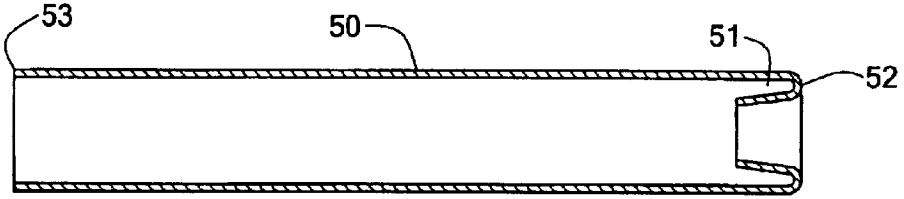
FIG. 17 is a cutaway view of a preferred embodiment of a tubular body used in the embodiment of FIG. 16.
Figure 18:
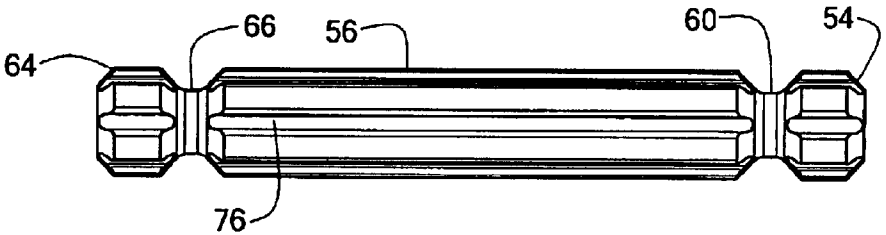
FIG. 18 is a side view of a preferred embodiment of a mandrel used in the embodiment of FIG. 16.
Figure 19:
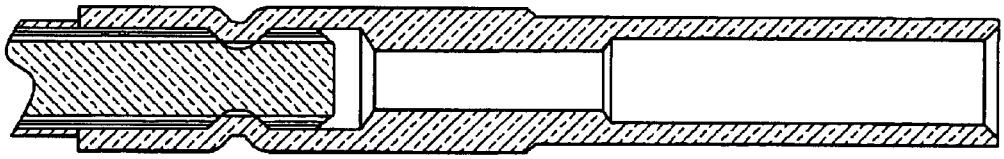
FIG. 19 is a cutaway view illustrating a crimp termination in the embodiment of FIG. 16.
Figure 20:
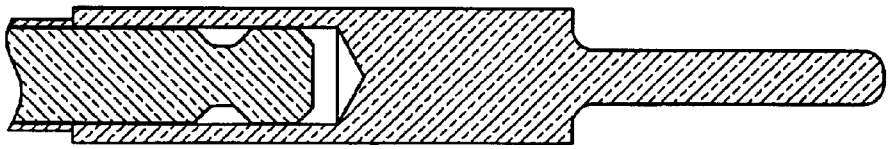
FIG. 20 is a cutaway view illustrating a pin termination in the embodiment of FIG. 16.
Figure 21:
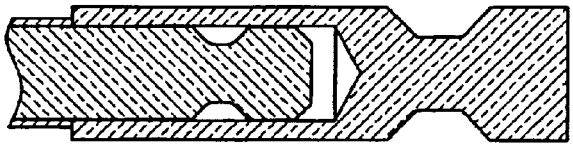
FIG. 21 is a cutaway view illustrating a surface mount pad termination in the embodiment of FIG. 16.
Figure 22:
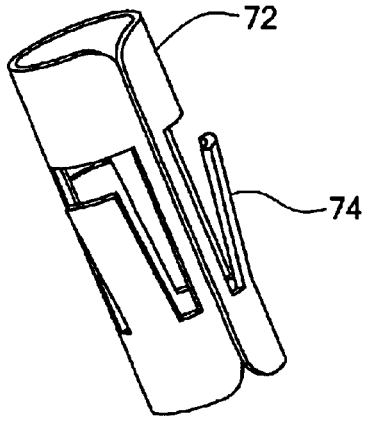
FIG. 22 is a pictorial view of a retention clip used in the embodiment of FIG. 16.

A preferred embodiment of the invention is illustrated beginning with FIG. 16 wherein a mandrel is employed during assembly of the contact wires and which remains part of the fabricated contact socket and to which various terminations can be attached. Referring to FIGS. 16–18, a tubular body 50 of a suitable metal or other conductive material has an outer end of inverted construction 52 defining an aperture for receiving a mating pin terminal. The other end 53 of the tubular body 50 is attached to one end 54 of a mandrel 56 at juncture 58 by rolling, crimping, swaging, or other suitable means to provide mechanical and conductive attachment of the tubular body to the mating end of the mandrel. The mandrel end 54, attachable to the tubular body, has a circumferential groove 60 into which the confronting portion of the tubular body is crimped or otherwise secured. The tubular body 50 contains a plurality of conductive wires 62 conductively and permanently affixed at one end in the annular recess 51 of the inverted end 52 of the tubular body, and at the other end between the tubular body and mating mandrel end. The wires are disposed in an angular disposition to the longitudinal axis to form a hyperboloid shape as discussed above. The outer end 64 of the mandrel is configured to receive a termination 68 which has a mating end 70 mechanically and conductively attachable to the mandrel end 64 by rolling, crimping, swaging or other suitable means. The confronting portion of the termination is crimped or otherwise secured into the circumferential groove 66 of the mandrel at the juncture 65. A retention ring or clip 72, shown in FIG. 22, is disposed on the mandrel 56, the clip having one or more outwardly angled wings or tabs 74 which can orient and lock the contact socket into an associated housing. The outer end of termination 68 can be of various types to suit particular requirements. For example, the termination may be of the solder cup type as shown in FIG. 16, a crimp type as shown in FIG. 19, a pin terminal as shown in FIG. 20, or a surface mount pad as shown in FIG. 21.

As best seen in FIG. 18, the mandrel 56 has a plurality of grooves or channels 76 formed longitudinally along the length thereof. In the illustrated embodiment six grooves or channels are provided on the mandrel which are equispaced about the circumference of the mandrel. A conductive wire is disposed in each respective groove 76 during assembly of the contact socket, as will be further described below.

Figure 23:
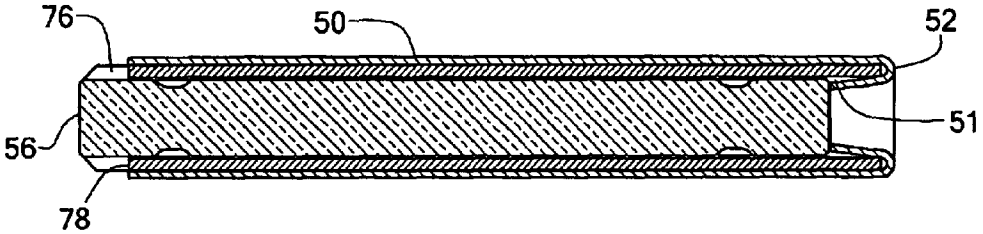
FIG. 23 is a cutaway view illustrating the mandrel and conductive wires inserted within the tubular body.
Figure 24B:
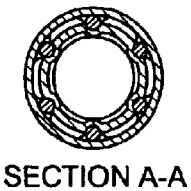
FIG. 24B is a sectional end view of FIG. 24A.
Figure 24A:
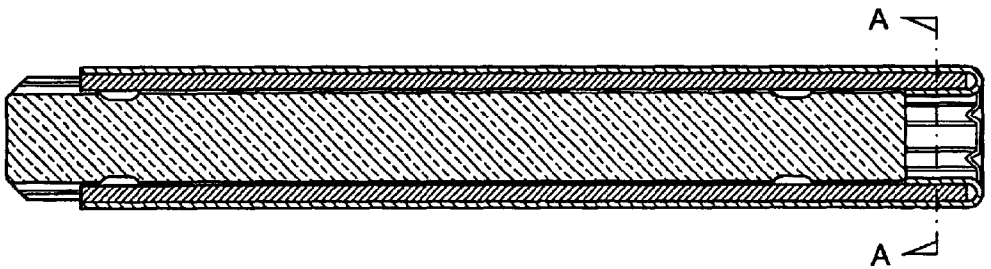
FIG. 24A is a cutaway view of the mandrel and conductive wires within the tubular body and illustrating the wires secured within the inverted end through deformation of the interior aspect of the inverted end of the tubular body.

The method of making the contact socket of the preferred embodiment of FIG. 16 will be described in conjunction with FIGS. 17–28. FIG. 17 shows a tubular body 50 having an inverted end 52 and a tubular opposite end 53. FIG. 18 shows the mandrel with longitudinal wire receiving grooves 76 equispaced about the circumference of the mandrel. The mandrel has a first end 54 and a second end 64 each having a circumferential groove 60 and 66 respectively formed therein. In similar manner to that described above with respect to FIG. 6, the body 50 can be held by gripper jaws and positioned over the mandrel. Wires 78 are inserted in respective grooves 76 of the mandrel 56 to a position at which the outer ends of the wires abut the inner annular recess 51 of the inverted end 52, as shown in FIG. 23. The inverted end is staked, crimped or otherwise suitably acted upon to mechanically and electrically secure the wires in place as shown in FIGS. 24A and 24B. In this embodiment, the inverted end is internally staked, crimped or otherwise suitably acted upon to deform portions of the tube end into the regions between the wires. The staking or crimping or otherwise suitable action is accomplished by a suitable tool, such as an expansion punch, which applies force outward from the interior of the inverted end toward the exterior thereof.

Figure 25:
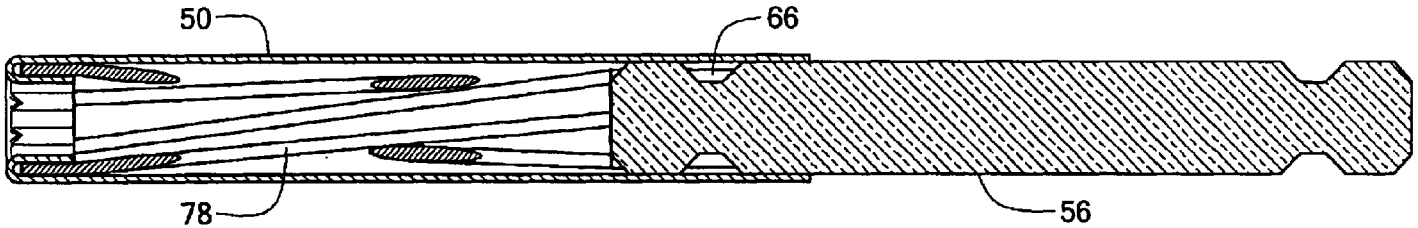
FIG. 25 is a cutaway view of the mandrel at a position to be secured to the tubular body.
Figure 26:
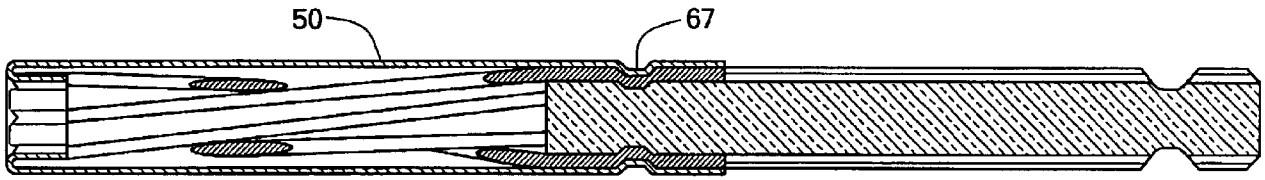
FIG. 26 is a cutaway view illustrating the tubular body secured to the mandrel.
Figure 27A:
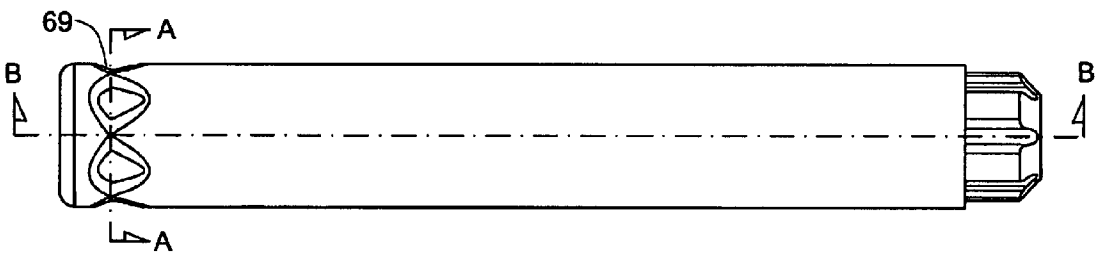
FIG. 27A is a side view of a tubular body and mandrel disposed therein and illustrating deformation of the exterior aspect of the inverted end of the tubular body.
Figure 27B:
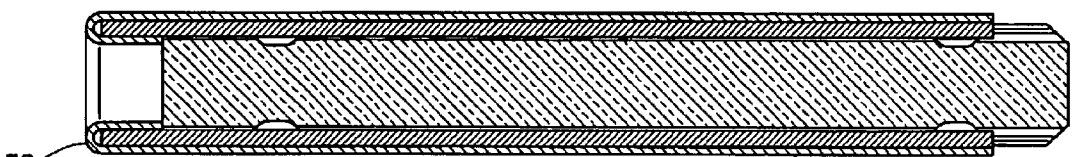
FIG. 27B is a cutaway view of the mandrel and conductive wires within the tubular body wherein the wires are secured within the inverted end of the tubular body.
Figure 27C:
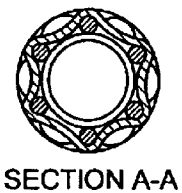
FIG. 27C is a sectional end view of FIG. 27A.

Next, the body 50 and mandrel 56 are moved relative to each other to position the mandrel at the opposite end of the tubular body, as shown in FIG. 25, and the body and mandrel are rotated relative to each other by a predetermined angular extent to produce an angular orientation of the wires 78. Ends of the wires 78 are conductively and permanently captured between the confronting portions of the tubular body and the mandrel in the region of the circumferential groove 66. As seen in FIG. 26, the body 50 is staked, crimped or otherwise secured into the groove 66 of the mandrel at the juncture 67 to secure the mandrel end to the tubular body and to secure the wires to maintain the hyperboloid contact shape.

As described above, the mandrel and tubular body can be moved relative to each other in different ways during the assembly process. For example, the mandrel may be fixed and the body movable with respect thereto. Alternatively, the tubular body may be fixed and the mandrel movable therein. As a further alternative, both the mandrel and body may be movable in relation to each other. These various forms of relative movement are determined by the particular assembly machines employed.

It will be appreciated that no welding need be employed in the preferred embodiment shown in FIG. 16. The wires are mechanically connected to the tubular body. Thus, the contact socket with the attached mandrel can be fabricated in one form and various terminations can then be attached to the mating end of the mandrel to suit user requirements. There is no need to fabricate a variety of different contact sockets having different terminations since the terminations can be separately fabricated and attached as needed to the contact socket with the attached mandrel. In this manner, the mandrel serves both as an assembly tool and as a connecting portion of the fabricated contact socket. The mandrel is then part of a termination assembly step in which the outer end of the mandrel is attachable to various types of terminations. The terminations may be of the various types illustrated above, or the terminations can be of any other type to suit particular user applications.

As in the embodiment described above, the contact socket usually has one or more retention mechanisms, or devices, for securing the contact socket in a housing or receptacle. As shown in FIG. 22, the retention mechanism, or device can be in the form of a retention ring or clip 72 having one or more outwardly angled tabs 74 or other retention elements which can orient and lock the contact socket into an associated housing or receptacle. The retention elements can be of various other forms such as barbs or ribs, and can be provided on a separate supporting structure, or can be integral with the body 50 as illustrated.

In an alternative embodiment, shown in FIGS. 27A–27D, the inverted end of the tubular body is externally staked, crimped or otherwise secured at the juncture 69 by a suitable tool which applies inward force from the exterior of the inverted end toward the interior thereof.

Figure 28B:
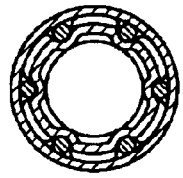
FIG. 28B is a sectional end view of FIG. 28A.
Figure 27D:
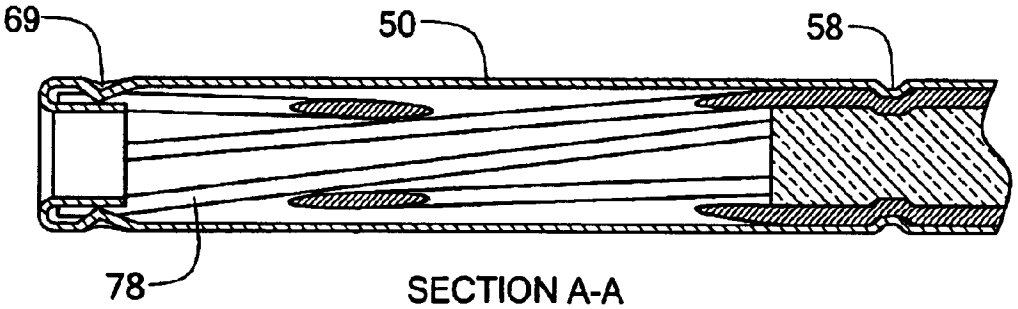
FIG. 27D is a cutaway view illustrating the tubular body secured to the mandrel.
Figure 28A:
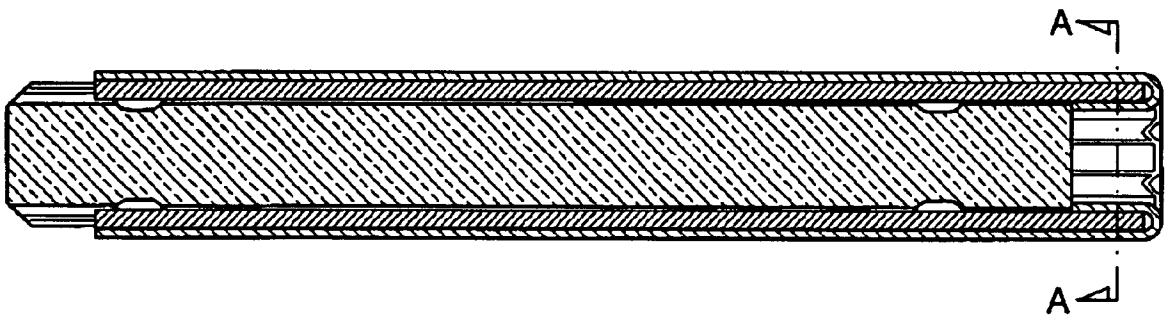
FIG. 28A is a cutaway view illustrating the deformation of the inverted end of the tubular body to provide longitudinally movable conductive wires.

As a further alternative implementation of an embodiment of the type shown in FIG. 16, the conductive wires can be staked, crimped or otherwise secured at the inverted end of the tubular body as shown in FIGS. 28A and 28B, such that they remain in conductive contact with the body but are longitudinally movable to accommodate thermal expansion which can occur when the wires are heated during contact use, especially at higher currents.

The wires at the opposite end of the tubular body are staked, crimped or otherwise secured as described above to be substantially immovable and in conductive contact with the body and mandrel. Alternatively, the conductive wires at both ends of the tubular body can be staked, crimped or otherwise secured to remain in conductive contact with the body but be longitudinally movable to accommodate thermal expansion.

For some purposes such as to suit particular specifications or performance requirements, the conductive wires can be welded at one or both ends of the tubular body as in the earlier embodiments described herein.

The invention is not to be limited by what has been particularly shown and described as various alternatives and modifications will occur to those of skill in the art without departing from the spirit and true scope of the invention.

What is claimed is:

1. A contact socket comprising:

a tubular body of electrically conductive material having an outer end and an inner end;

a plurality of conductive wires having first ends affixed only to the inner surface of the tubular body at the outer end and having second ends affixed only to the inner surface of the tubular body at the inner end;

the wires being spaced from each other and lying in an angular disposition to the longitudinal axis of the body to form a hyperboloid shape; and a termination at the inner end of the body.

2. The contact socket of claim 1, wherein the outer end of the tubular body has an annular region defining a stop against which the first ends of the wires are abutted and defining an entrance aperture for a mating pin, and protecting the first ends of the wire during insertion of a mating pin.

3. The contact socket of claim 1 wherein the annular region is defined by an inverted outer end of the tubular body.

4. The contact socket of claim 1 wherein the annular region is defined by a lip at the outer end of the tubular body.

5. The contact socket of claim 1 wherein the termination includes a mandrel having one end attached to the inner end of the tubular body.

6. The contact socket of claim 1 wherein the termination includes a mandrel having one end attached to the inner end of the tubular body and an outer end attachable to a termination end.

7. The contact socket of claim 1 wherein the tubular body is gold plated copper alloy.

8. The contact socket of claim 1 wherein the tubular body is formed by a deep drawing process.

9. The contact socket of claim 1 wherein the termination is formed by a deep drawing process.

10. The contact socket of claim 1 wherein the wires are gold plated copper alloy.

11. The contact socket of claim 1 wherein the wires are rotated into the hyperboloid shape.

12. The contact socket of claim 1 wherein the conductive wires are welded only to the inner surface of the tubular body.

13. The contact socket of claim 1 wherein the conductive wires are laser welded only to the inner surface of the tubular body.

14. The contact socket of claim 1, wherein the termination has a configuration for attachment to a mating electrical device.

15. The contact socket of claim 14 wherein the termination is attached to the tubular body.

16. The contact socket of claim 14 wherein the termination is integral with the tubular body.

17. The contact socket of claim 14 wherein the termination includes a solder cup.

18. The contact socket of claim 14 wherein the termination includes a crimp connector.

19. The contact socket of claim 14 wherein the termination includes a pin terminal.

20. The contact socket of claim 14 wherein the termination includes a surface mount pad.

21. A contact socket comprising:

a tubular body of electrically conductive material having an outer end and an inner end;

a plurality of conductive wires having first ends affixed only to the inner surface of the tubular body at the outer end and having second ends affixed only to the inner surface of the tubular body at the inner end;

the wires being spaced from each other and lying in an angular disposition to the longitudinal axis of the body to form a hyperboloid shape; and a mandrel having one end attached to the inner end of the tubular body and an outer end attached to a termination end having a configuration for attachment to a mating electrical device.

22. The contact socket of claim 21 wherein the outer end of the tubular body ham an annular region defining a stop against which the first ends of the wires are abutted and defining an entrance aperture for a mating pin, and protecting the first ends of the wire during insertion of a mating pin.

23. The contact socket of claim 21 wherein the annular region is defined by an inverted outer end of the tubular body.

24. The contact socket of claim 21 wherein the termination end includes a solder cup.

25. The contact socket of claim 21 wherein the termination end includes a crimp connector.

26. The contact socket of claim 21 wherein the termination end includes a pin terminal.

27. The contact socket of claim 21 wherein the termination end includes a surface mount pad.

28. A contact socket comprising:

a single tubular body of electrically conductive material having an outer end and an inner end;

a plurality of conductive wires having first ends affixed only to the inner surface of the tubular body at the outer end and having second ends affixed only to the inner surface of the tubular body at the inner end;

the wires being spaced from each other and lying in an angular disposition to the longitudinal axis of the body to form a hyperboloid shape; and a termination at the inner end of the body.

* * * * *

UNITED STATES PATENT AND TRADEMARK OFFICE

CERTIFICATE OF CORRECTION

PATENT NO. : 6,767,260 B2
DATED : July 27, 2004
INVENTOR(S) : Victor Beloritsky et al.

It is certified that error appears in the above-identified patent and that said Letters Patent is hereby corrected as shown below:

Column 9,
Line 20, “ham” should read -- has --.

Signed and Sealed this

Twenty-fourth Day of May, 2005

JON W. DUDAS
*Director of the United States Patent and Trademark Office*